US008555541B2

(12) United States Patent
Ingram

(10) Patent No.: US 8,555,541 B2
(45) Date of Patent: Oct. 15, 2013

(54) TACTICAL BUTT STOCK WITH ROUNDED BUTT PLATE

(75) Inventor: Donald Ingram, Lexington, KY (US)

(73) Assignee: P & S Products, Inc., Lexington, KY (US)

( * ) Notice: Subject to any disclaimer, the term of this patent is extended or adjusted under 35 U.S.C. 154(b) by 396 days.

(21) Appl. No.: 13/007,712

(22) Filed: Jan. 17, 2011

(65) Prior Publication Data

US 2011/0173863 A1 Jul. 21, 2011

Related U.S. Application Data

(60) Provisional application No. 61/336,254, filed on Jan. 19, 2010.

(51) Int. Cl.
*F41C 23/00* (2006.01)

(52) U.S. Cl.
USPC ..... 42/71.01; 42/73; 42/74

(58) Field of Classification Search
USPC ..... 42/71.01, 73, 74
See application file for complete search history.

(56) References Cited

U.S. PATENT DOCUMENTS 6,543,172 B1 * 4/2003 Armstrong ..... 42/71.01
2010/0242333 A1 * 9/2010 Kincel ..... 42/73

* cited by examiner

*Primary Examiner* — J. Woodrow Eldred
(74) *Attorney, Agent, or Firm* — Michael Coblenz

(57) ABSTRACT

A removable butt stock with a curved and rounded butt plate for use in the tactical fighting position is disclosed. The removable butt stock has a single orientation two position release lever for ease of adjustment and removable of the butt stock from the buffer tube of the tactical weapon, ribs incorporated into the receiver bore to reduce drag during insertion of the buffer tube, and anti-rattle springs to securely attach the butt stock to the buffer tube. The body of the butt stock has an angled cheek weld to allow the user to comfortably align the eye on the weapon in the tactical firing position. The butt stock also includes two storage tubes with cam caps designed to be easily removable by twisting in a cam motion up the beveled mouth of the storage tube.

17 Claims, 10 Drawing Sheets

TACTICAL BUTT STOCK WITH ROUNDED BUTT PLATE

CROSS REFERENCE TO RELATED APPLICATIONS

This application claims priority to U.S. provisional application Ser. No. 61/336,254 filed Jan. 19, 2010, and incorporated herein by reference.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

1. Field of the Invention

The present invention relates to a modified butt stock for a tactical weapon. The modified butt stock includes a rounded butt plate and a modified release lever for ease of attachment and removal from a weapon.

2. Description of the Related Art

Modern military weapons typically are made from a number of components that are designed and configured for easy assembly and disassembly. This allows the weapons to be disassembled quickly and easily for storage, shipping and cleaning As a result, many weapons come with a number of different configurations. There are, for example, a number of different configurations for butt stocks for the standard military assault rifle, the/M-4, which is a modified and updated version of the M-16. Similarly there are numerous versions for the civilian version of the weapon, the AR-15.

These butt stocks are attached to the weapon by means of a tube which projects from the rear of the weapon, known as the buffer tube. Buffer tubes typically have a series of even spaced holes along the bottom of the tube, and the butt stock is secured by a pin that engages within one of the holes. The spaced holes allow the user to adjust the position of the butt stock to shorten or lengthen the total length of the weapon, or more importantly the distance from the back of the weapon, the butt plate, to the trigger and sight of the weapon to accommodate different sized users. A shorter user will desire a shorter distance from the butt plate to the trigger and sight than a taller user. A properly sized weapon will improve the users ability to aim and fire the weapon.

There are a number of common problems with these removable butt stocks. One problem involves the standard release lever. The release lever moves the locking pin which holds the stock into the buffer tube and allows the user to adjust the length of the weapon, or remove the butt stock from the weapon. Most release levers incorporate a locking nut to lock the release lever to secure the butt stock onto the buffer tube. This means that when the user wants to adjust the position of the butt stock he or she has to unscrew the locking nut. This means that it is not particularly easy to remove the removable butt stock. It takes one hand to unscrew the locking nut, and the other to hold and stabilize the body of the weapon. There is a need, therefore, for a simple and user friendly release lever that allows a user to manipulate the release lever with one hand and adjust the position of the butt stock with the other hand.

Another common problem with removable butt stocks is that the buffer tube may not fit perfectly, or snuggly, into the butt stock. This is caused by slight variations in the molding or manufacturing of the butt stock. In those cases the butt stock can have a small shimmy or rattle caused by the movement on the buffer tube in the butt stock. This rattle can cause noise, which could potentially be deadly for the user of the weapon. Many of these weapons are carried by civilian law enforcement agents, and in many situations they do not want their movements or presence known. There is a need, therefore, for a modified butt stock with a means for reducing the potential rattle caused by the misfit between the butt stock and the buffer tube.

Removable butt stocks have been common on military assault weapons for a number of years. Most butt stocks have a butt plate with a slight concave curve. This allows the user to comfortably rest the weapon against the shoulder with the curve of the butt plate cupping around the user's shoulder. This is the common placement of the butt plate in what is known as the classic firing position. U.S. Pat. No. 6,925,743 and U.S. Pat. No. 7,337,573, both to DiGiovanna, are drawn to a modified butt stock with a two position butt plate. The patents describe in detail the classic firing position. "In the classical shooting position, the butt stock is placed in the shoulder pocket of the shooter. The shooter's shoulders and feet are at approximately a 30° angle to the direction of the firearm and the shooter's head is lowered and forward such that his cheek is firmly on the top of the butt stock and the shooter's dominant eye is aligned with the firearm's sights."

The widespread introduction of body armor has forced a change in the standard firing position. The classic firing position forces the soldier to stand at an angle to the potential target, and exposes the non-dominant arm which is holding the weapon, and more importantly the arm opening in the body armor. According to the '573 patent, the use of "the classical shooting position while in a tactical or close quarter battle (CQB) situation exposes the shooter to additional risk. In a tactical situation, a shooter typically wears body armor which protects the front and back of the torso of the shooter. However, it does not protect the arms of the shooter and, as such, if the shooter is confronting a threat in the classical shooting position the firearm will typically be pointed towards the threat, the shooter will be standing at a 30° angle to the direction of the firearm, and as such a 60° angle to the threat. This exposes the opening in the body armor where the non-dominant arm goes through the body armor. Upper torso wounds from small arms fire in combat can enter through this opening."

This has forced a reevaluation of tactics, and the development of the Tactical Fighting Position (TFP). In the TPF, the soldier stands square to the target, which maximizes the coverage of the body armor. This position also allows better movement and a fuller range of vision from the classic angled fighting and firing position. It allows the solder to walk forward with the weapon raised and aimed in the general direction of potential targets. In this position the weapon is held high on the chest with the butt stock resting between the top of the pectoral chest muscle and the clavicle (collar bone). Standard butt stocks, which were designed for the classic shooting position and have concave butt stocks designed to sit comfortably against the shoulder, typically have a sharp end at the bottom of the butt stock, which can dig into the chest muscles in the TFP.

The '573 patent describes the tactical fighting position. "In the tactical shooting position, the shooter stands so that his shoulders and feet are perpendicular to the direction of the firearm. The bottom corner of the butt stock is placed against the shooter's dominant side, upper chest at the mid-clavicular line, while the shooter's head is upright and looking forward. The firearm is carried in the ready position until a threat is confronted. In the ready position, the firearm is pointed downward at a 45° angle towards the ground. Once a threat is confronted, the firearm is raised and pointed toward the threat, and the shooter's shoulders and feet are maintained at a perpendicular orientation to the direction of the firearm. With the firearm in the tactical shooting position, the top of the butt stock is against the shooter's dominant side cheek and the shooter's dominant eye is in line with the sights. The tactical shooting position provides the shooter with an optimal amount of protection from the body armor. It also provides the shooter with a better vision for additional threats coming from the non-dominant side of the shooter." Movement of the weapon from the ready position to the firing position requires that the weapon be rotated upward with the butt plate against the upper body, which can create pressure and strain on the upper chest muscles, particularly when the butt plate has a pointed end, or has sharp edges. There is a need, therefore, for a butt stock with a rounded bottom and curved edges to allow ease of use and increased comfort in the tactical fighting position.

In the tactical firing position the shooter rests his cheek against the body of the butt stock to properly align his aiming eye with the sight of the weapon. Standard butt stocks have a rounded body, which can become uncomfortable if the cheek is rested against it for a length of time. There is a need, therefore, for a butt stock with a surface designed to properly align with the shooters cheek to provide a comfortable surface. Typical butt stocks also have numerous external parts, most commonly clips for the attachment of the weapon strap or for the attachment of other items. These clips can be snagged on articles of clothing, as well as on trees or bushes in the field. Additionally, if the release lever is exposed it can potentially snag on clothing or other things, and in this situation the position of the butt stock could be inadvertently altered. There is a need, therefore, for a butt stock with an enclosed latch guard handle to prevent the possibility of snagging.

Typical butt stocks are made of cast plastic and often have hollow interior spaces to reduce the weight of the butt stock. It has become common to incorporate storage areas within these hollow spaces so that soldiers or other users can store items in their weapon. One of the most common things to store within the hollow spaces of the weapon are batteries, which are used for a variety of attachable equipment such as flashlights and night vision scopes. It is also common to store weapon cleaning items within these storage tubes. One of the problems encountered with standard storage tubes is providing a proper cover that is secure but easy to attach and remove. Some storage tube covers screw in while others are secured with an O-ring that provides a snug fit. Often these can become too tight and make it difficult to remove the cover. There is a need, therefore, for a storage cap that is easy to install and remove yet remains securely in place.

SUMMARY OF THE INVENTION

It is an object of the present invention to overcome a number of the drawbacks in existing butt stocks. A primary object of the invention is to provide a tactical butt stock with a rounded butt plate that allows the user to easily and comfortably roll the weapon from the ready position to the firing position when used in the tactical fighting position. The rounded butt plate is created by having the bottom of the butt stock curved inward, and having the bottom of the butt stock padding curved side to side to create a semi-spherical rounded ball on the back bottom of the butt plate.

A second major object of the invention is to provide a reliable and easily usable release lever to allow the user to easily release the butt stock with one hand. This is accomplished by means of a bi-directional release lever with an initial movement sufficient to allow the butt stock to be positioned on the buffer tube of the weapon, and a second movement sufficient to allow the butt stock to be removed from the buffer tube of the weapon. The user of the weapon can adjust the position of the butt stock on the weapon by pulling up on the release lever, which will remove a locking pin from a corresponding adjustment slot in the buffer tube, and allow the butt stock to move on the buffer tube. The user can, therefore, hold the butt stock in one hand and the weapon in the other, and easily adjust the position by squeezing up on the release lever. The user can remove the butt stock from the weapon by pulling down on the release lever, which will allow the locking pin to move enough to allow the butt stock to be removed from the buffer tube of the weapon.

A further object of the invention is to include a number of anti-rattle springs located within the receiver bore of the butt stock, and which securely attach the butt stock to the buffer tube of the weapon. The anti-rattle springs press against the buffer tube when inserted into the butt stock and apply sufficient pressure to prevent the buffer tube from moving slightly and creating potential rattling noises. Another object of the invention is to incorporate a series of ribs within the receiver bore which will reduce drag when the buffer tube is inserted into the receiver bore. An additional feature of the ribs is that it will allow for easier cleaning of the receiver bore. Another object of the invention is to incorporate an angled cheek weld area on the body of the butt stock which will allow easier and more comfortable cheek placement and alignment for aiming of the weapon. Yet another object of the invention is to include incorporated storage tubing within the body of the butt stock wherein the storage tubes have a cam cap that allows easy opening and closing of the storage tube by twisting the cap and allowing it to slide up, in a cam-like motion, along the beveled mouth portion of the storage tube. A final object of the invention is to configure the handle portion of the butt stock to incorporate all of the features along with the attachment points within the enclosed handle to minimize the possibility of snagging the weapon on clothing or external objects.

DETAILED DESCRIPTION OF THE INVENTION

Detailed embodiments of the present invention are disclosed herein. It is to be understood that the disclosed embodiments are merely exemplary of the invention, and that there may be a variety of other alternate embodiments. The figures are not necessarily to scale, and some features may be exaggerated or minimized to show details of particular components. Therefore, specified structural and functional details disclosed herein are not to be interpreted as limiting, but merely as a basis for teaching one skilled in the art to employ the varying embodiments of the present invention.

Figure 1:
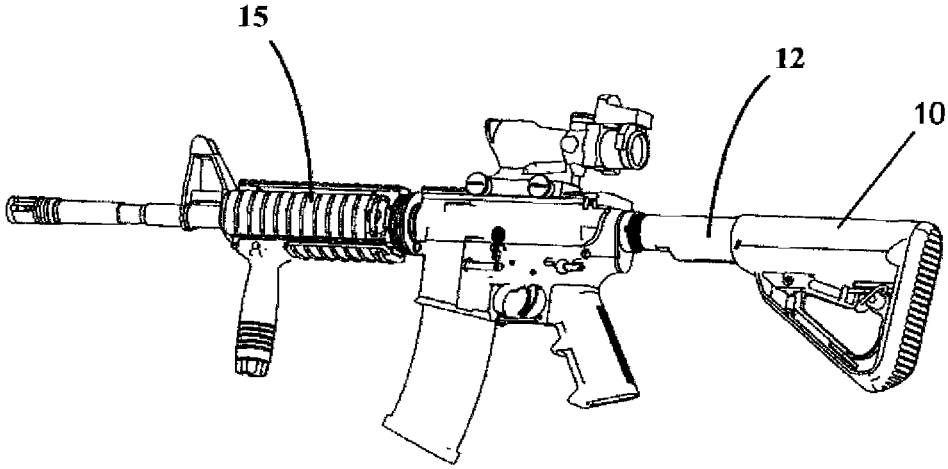
FIG. 1 is a perspective view of the tactical butt stock attached to a weapon.

FIG. 1 depicts the tactical butt stock 10 attached to a weapon 15. The weapon shown is a standard U.S. Military M-4, but detachable butt stocks are used on a variety of weapons. The butt stock 10 is attached to the weapon 15 by means of a buffer tube 12 which extends from the rear of the weapon. For some weapons the buffer tube is a cylindrical tube, but for many modern weapons the buffer tube incorporates a longitudinal anti-rotation key that runs along the bottom of the tube. There are a series of holes or slots along the bottom of the tube which allows the user to mount the butt stock 10 at different positions, allowing the lengthening or shortening of the weapon. While the specifics vary from weapon to weapon, for most butt stocks 10 and buffer tubes 12, the butt stock 10 can be adjusted in approximately one half inch increments and for a total change in length of approximately four inches.

Figure 2:
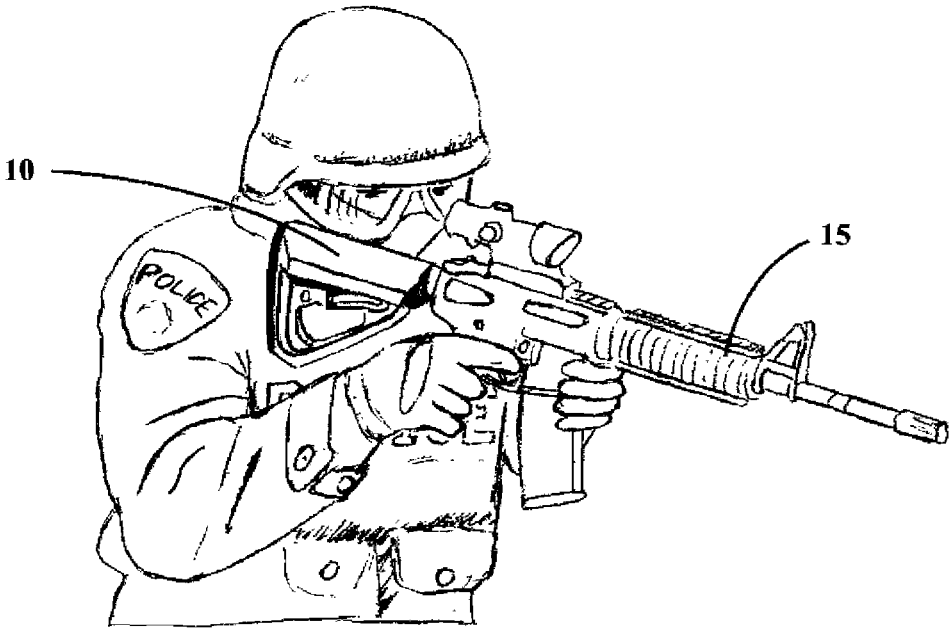
FIG. 2 is a perspective view of a user holding the weapon with the tactical butt stock in the tactical fighting position.

FIG. 2 depicts a user carrying the weapon 15 in the tactical fighting position. As can be seen, the butt stock 10 sits high on the user's body, at the top of the chest muscle and just below the collar bone. The user moves the weapon from the ready position, which is with the barrel of the weapon 15 facing downward at about 45 degrees, into the tactical firing position by rotating the barrel upward to aim at the target. This rotation uses the bottom of the butt pad portion of the butt stock 10 as the pivot point of the rotation. Standard butt stocks have pointed or sharp ends at the bottom as well as sharp edges on the sides, which can cause discomfort to the soldier, but the rounded end portion of the butt stock 10 of this invention is curved and rounded to prevent discomfort. FIG. 2 also shows the user with the cheek pressed against the butt stock to align the dominant eye—which is best for aiming—with the sight of the weapon.

Figure 3:
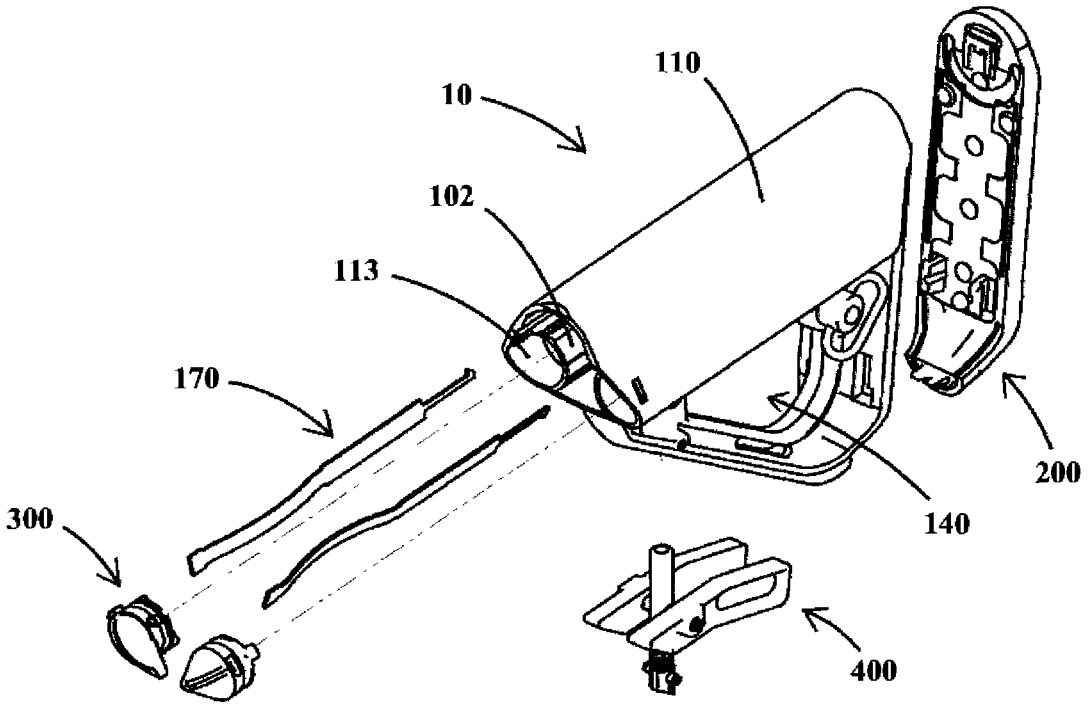
FIG. 3 is an exploded perspective view showing the elements of the tactical butt stock.

FIG. 3 is an exploded perspective showing the major components of the tactical butt stock 10 of the disclosed invention. Most of the major elements are disclosed in FIG. 3, and described in more detail below. The butt stock 10 is comprised of a butt stock frame 100 which consists of a body 110 with an integrated enclosed handle 140. The frame 100 is made from a single piece of molded hard thermoplastic, and the body 110 and handle 140 are molded together in a single piece of material. In the preferred embodiment the thermoplastic is a glass filed nylon, but the stock can also be molded from any sufficiently rigid polymer. There is a padded butt plate 200 with a rounded butt bottom 223 attached to the back 120 of the stock 10. The body 110 is largely hollow, and contains two enclosed storage tubes 113, and a receiver bore 102. The receiver bore 102 is sized to accommodate the buffer tube 12 of the weapon 15. Various weapons have different sized buffer tubes 12, and the receiver bore 102 will be sized to accommodate the specific size of the weapon buffer tube 12. The storage tubes 113 run the length of the body 110 and are closed by means of cam cap plugs 300 that are sized to snugly and securely fit into the opening of the storage tubes 113. The buffer tube 12 is locked into place within the receiver bore 102 by means of a locking pin 410 controlled by the release lever assembly 400. The handle 140 protects the release lever 400 and prevents potential snagging of the butt stock 10 while in use. There are a series of ribs 160 (not visible in FIG. 3) within the receiver bore 102 to reduce drag during insertion, movement, and removal of the buffer tube 12 within the receiver bore 102. There are two anti-rattle springs 170 mounted within the receiver bore 102 that press against the buffer tube 12 to securely hold it in place within the receiver bore 102 and prevent any potential rattle or shimmy. As can be appreciated the receiver bore 102 may not have precisely the same inner circumference as the outer circumference of the buffer tube 12. In those situations there may be some play or movement of the buffer tube 12 within the receiver bore 102. That movement may cause noise, most commonly a rattling sound of plastic on metal. The anti-rattle springs 170 squeeze the buffer tube 12 securely in place within the receiver bore 102.

Figure 4:
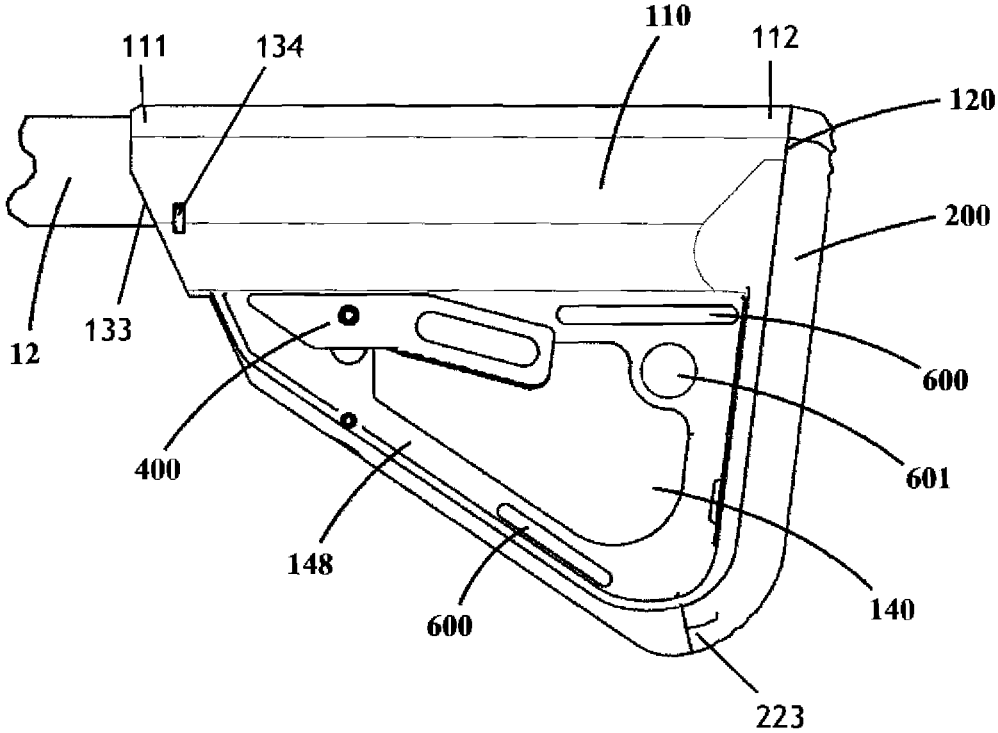
FIG. 4 is a side plan view of the butt stock.
Figure 5:
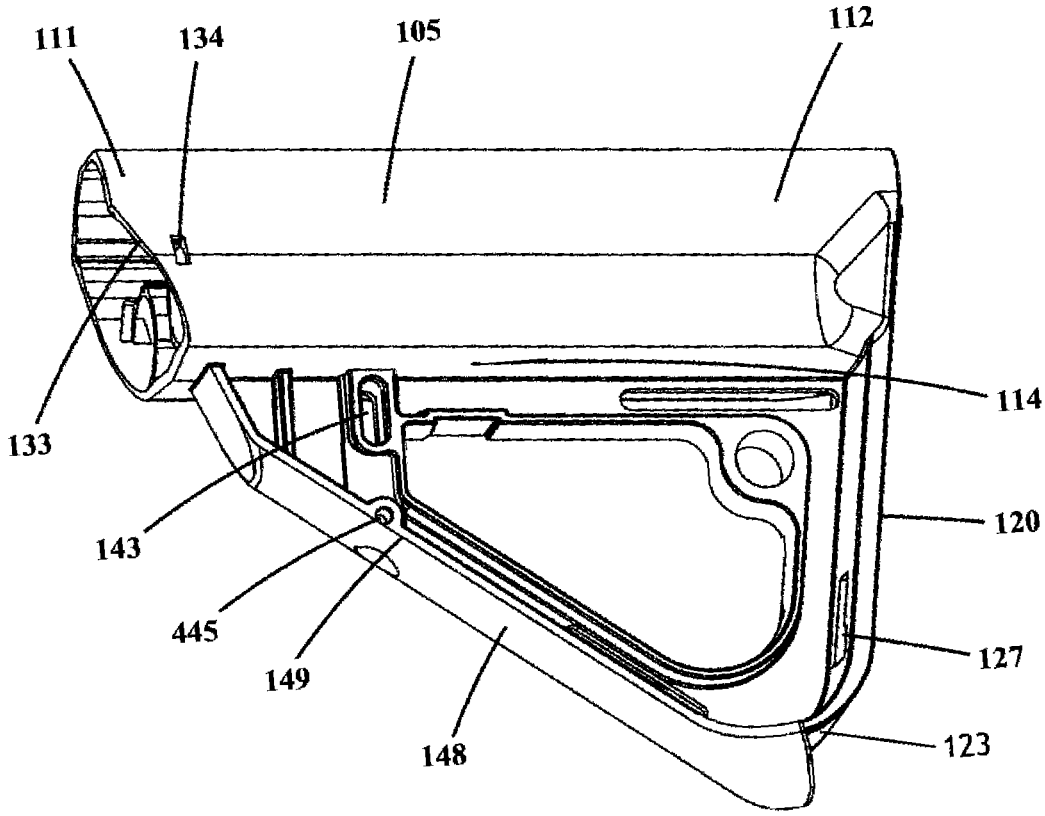
FIG. 5 is a side perspective view of the butt stock frame without any attached components.
Figure 6:
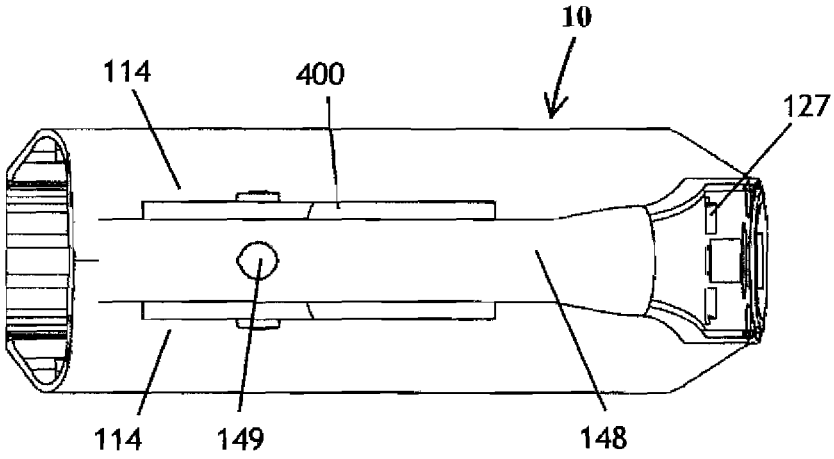
FIG. 6 is a bottom plan view of the butt stock.

FIG. 4 is a side view of the butt stock 10, and FIG. 5 is a side perspective view of the butt stock frame 100. The butt stock 10 is symmetrical, with all components identical on both the right and left side, which allows the butt stock 10 to be used by both left and right handed users. The butt stock frame 100 is roughly triangular, with the body 110 on top, and the enclosed handle 140 attached below. The body 110 has a front 111 a back 112 and an underside 114. An extended back plate 120 is integral and attached to the back 112 of the body 110, and extends downward. The orientation descriptions of top and bottom, up and down, front and back, rear and forward, and left and right, are all in relation to the butt stock 10 as mounted on the weapon 12 and as manipulated by the user. In most positions the user will hold the weapon with the butt stock 10 against the body, grip the trigger portion with the dominant hand and stabilize the weapon with the other hand, as seen in FIG. 2. In this position the top of the butt stock 10 will be up, or above, the enclosed handle 140, and the back of the butt stock 10 will be away from the barrel of the weapon 15. FIG. 6 is a bottom view of the butt stock 10.

Figure 7:
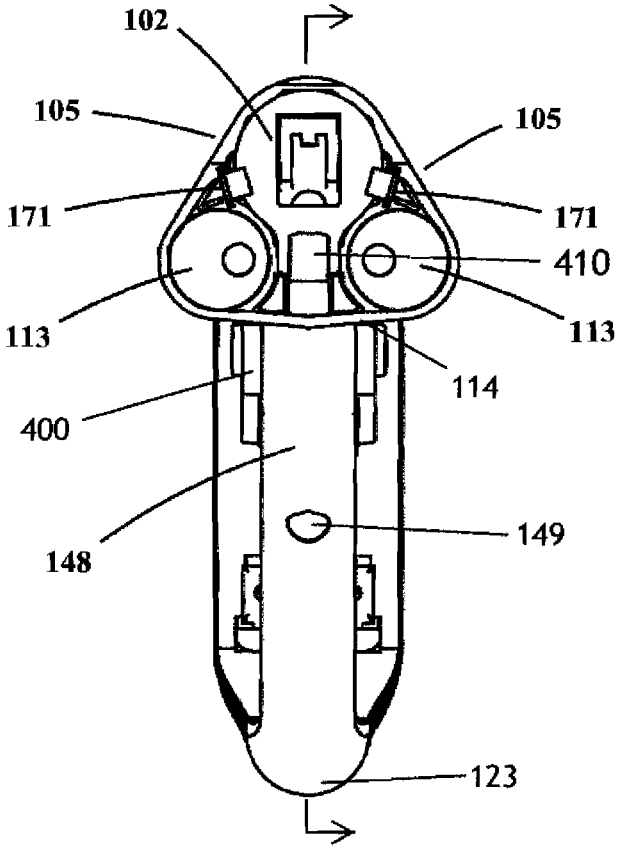
FIG. 7 is a front plan view of the butt stock.

As seen in the front view, FIG. 7, the body 110 is roughly triangular in shape with curved ends. This triangle shape is created by the position of three tubes: at the top middle of the triangle is the receiver bore 102, and sitting below the receiver bore 102 on either side are the two storage tubes 113. The receiver bore 102 is not precisely a circular tube, but rather has a circular top portion with a longitudinal channel that runs below it, the channel formed by the two parallel storage tubes 113. The longitudinal anti-rotation key of the buffer tube 12 of the standard AR15/M-16 sits in this longitudinal channel. The receiver bore 102 is nearly circumferential as it sits above the two parallel storage tubes 113. The side of the triangle on the body 110 is angled and creates and angled cheek rest, referred to herein as the cheek weld 105. In the tactical firing position the weapon is raised up to about shoulder height to aim at the target, and the user rest the check below the dominant eye against the butt stock 10 to align the eye with the sight of the weapon. Because of the way that the cheek rests against the weapon it is desirable to have the portion of the butt stock 10 beveled at an angle that roughly corresponds to the angle of the cheek of the shooter. The cheek weld 105 sits at approximately a 45 degrees angle, and is designed to be approximately the correct angle to maximize the comfort of the shooter when he or she places the cheek against the butt stock 10. The cheek weld 105 is angled to allow the user's cheek to rest comfortably against the butt stock 10. There is a cheek weld 105 on both sides of the butt stock 10 to accommodate both right and left handed shooters.

As depicted in FIG. 4 and FIG. 5, the enclosed handle 140 is formed by the extended back plate 120 of the butt stock frame 100, which extends down from the body 110. There is a latch guard 148 which is attached to the lower portion 123 of the back plate 120 and the underside 114 of the front 111 of the body 110 to form a triangular enclosed handle 140. The latch guard 148 is a bar with a curved underside running from the lower portion 123 to the front 111 underside 114, leaving and opening in the middle of the handle 140. There is a flange of material that extends partially inward from the underside 114, the extended back plate 120 and the latch guard 148. There are a number of strap slots 600 formed in the flange for the purpose of attaching a weapon shoulder or carrying strap. FIG. 4 shows 2 strap slots 600, but there could be more depending upon the needs and requirements of the end user of the butt stock 10. There is also a clip hole 601 within the flange of the enclosed handle 140. The clip hole 601 is sized to accommodate a standard mounting clip, and can be accessed from either side so that the clip can be mounted on either side. The latch guard 148 creates a full enclosure to protect the release lever 400 as well as the attachment points or components to prevent them from potentially snagging on clothing or other foreign objects.

Figure 8:
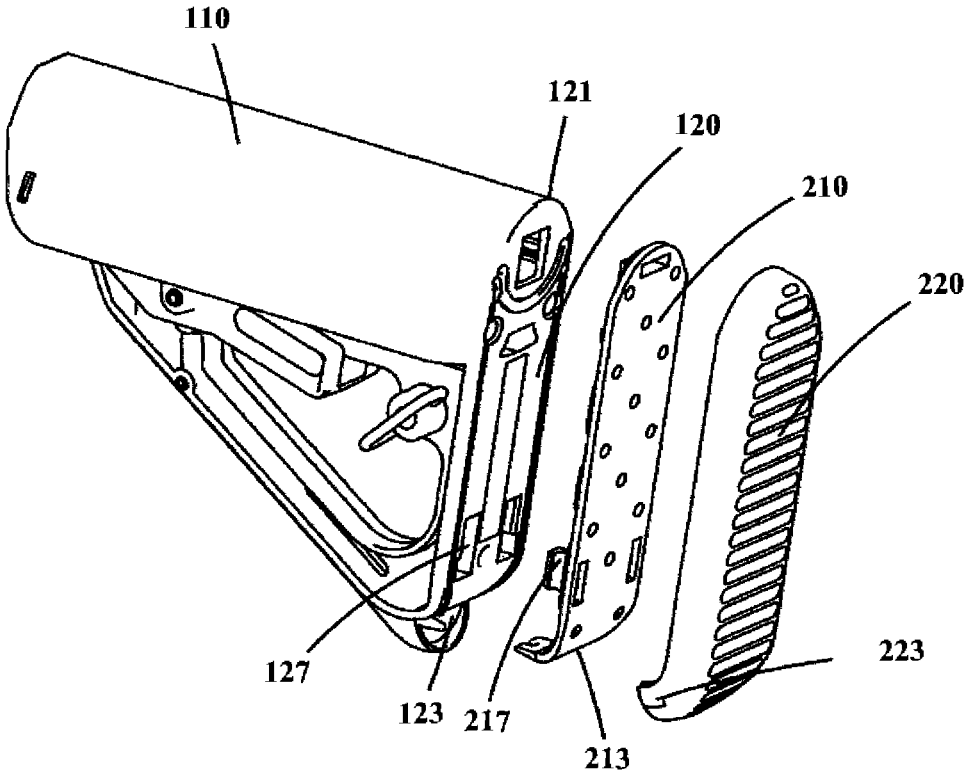
FIG. 8 is an exploded perspective view of the back of the butt stock showing the butt plate.
Figure 9:
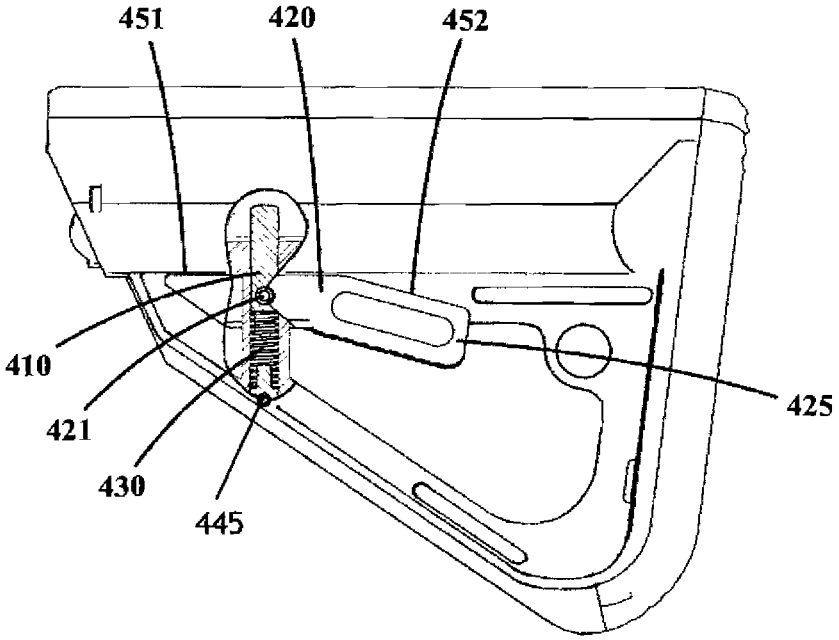
FIG. 9 is a side plan view with a partial cut-away showing the components of the release lever.
Figure 10:
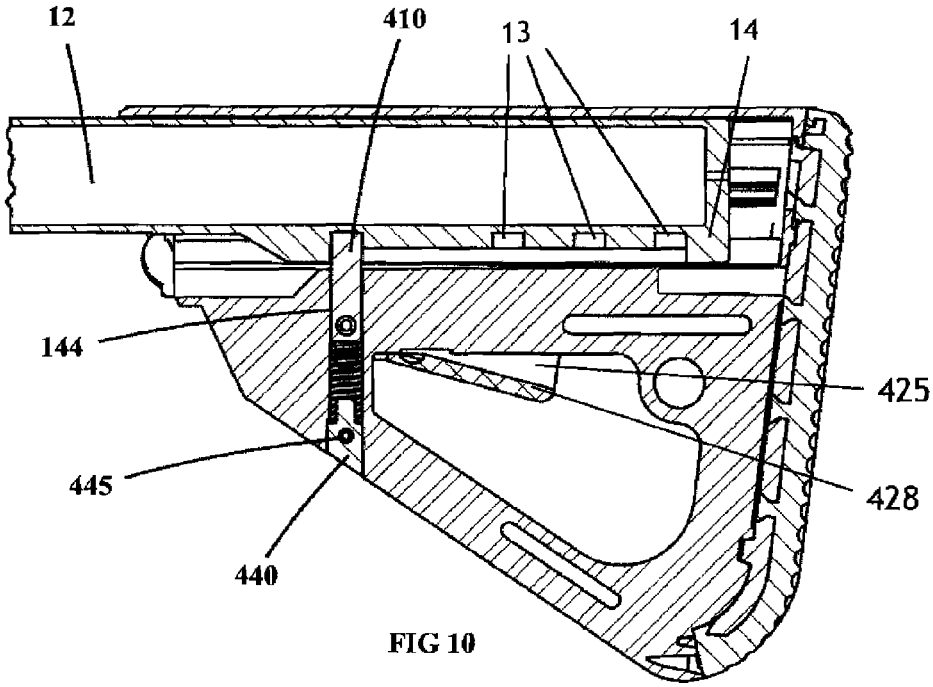
FIG. 10 is a side cross sectional view of the butt stock with the buffer tube and release levers in place.
Figure 11:
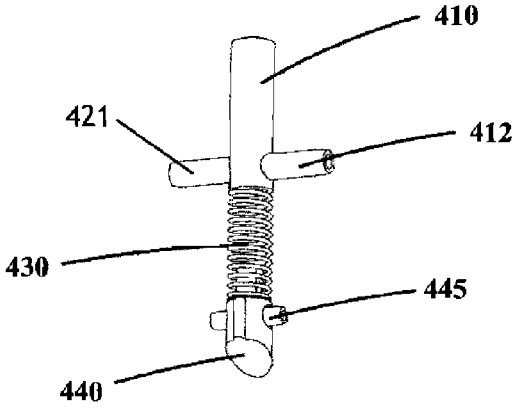
FIG. 11 is a detailed perspective of the locking pin assembly.
Figure 12:
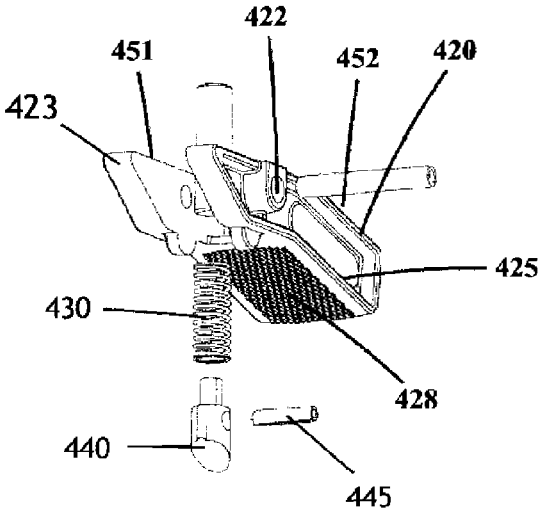
FIG. 12 is a perspective exploded view showing the elements of the release lever.
Figure 13:
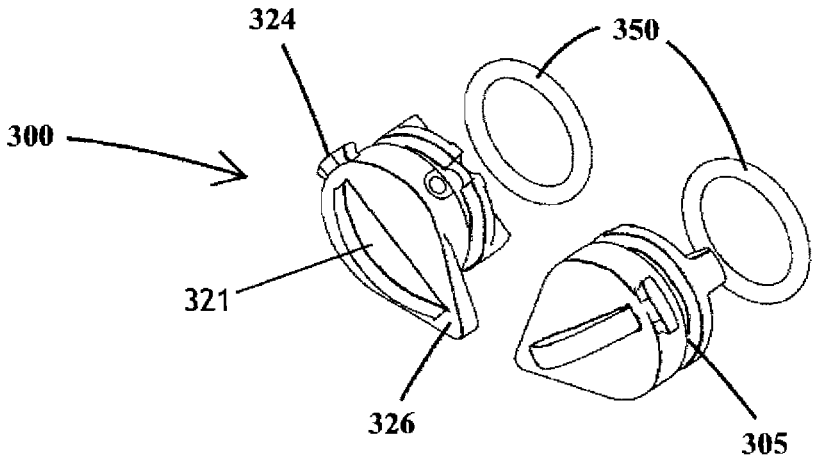
FIG. 13 is a perspective exploded view showing the elements of the cam cap plug.
Figure 14:
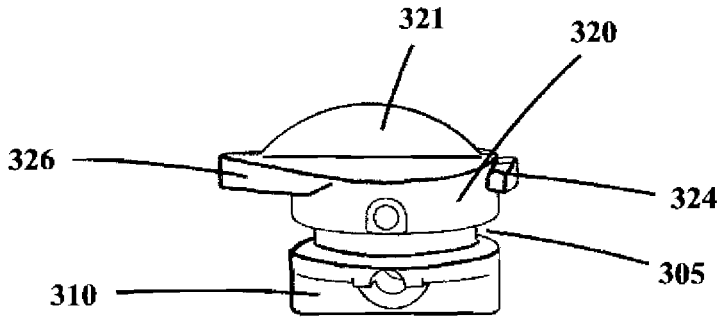
FIG. 14 is a side plan view of the cam cap plug.

As seen in FIG. 8, the butt stock frame 100 has an extended back plate 120 with a back plate top 121 and a back plate bottom 123. Referring to FIG. 4, the back plate bottom 123 curves inward onto the lower portion of the latch guard 148 forming about a quarter circle curve. As seen in FIG. 7, the lower portion of the latch guard 148 is curved in approximately a half-circle. There are a series of attachment slots 127 molded into the extended back plate 120 of the frame 100. The attachment slots 127 are rectangular openings in the back plate 120. The second component of the comfort butt is the pad insert 210, which is sized and shaped to correspond to, and connect to, the back plate 120. The insert 210 has a curved bottom portion 213 that corresponds to the curved portion of the back bottom 123. The insert 210 has a series of prongs 217 that are sized and configured to insert into the attachment slots 127 and to lock the insert 210 into place against the back 120 of the stock 10. The prongs 217 are just slightly less wide than the slots 127 are long and have a protrusion with a tab on the top. The protrusion extends into the slot and the tab locks the prongs 217 into place. Such prong and slot connections are well known in the plastic molding and plastic component arts.

The third component of the padded butt plate 200 is the pad overmold 220. The overmold 220 is made of a moderately soft flexible material such as rubber, or rubberized plastic. In the preferred embodiment the overmold 220 is made from sanoprene, but any suitable non-rigid polymer would work. A wide variety of materials can be used as long as the material is soft but without too much give, has suitable shock absorbing features, and is somewhat sticky or tacky to the touch. The shape of the overmold 220 roughly corresponds to the shape of the pad insert 210. The overmold 220 is, as the name suggested, molded onto the insert 210, which ensures that the overmold 220 is securely attached to the insert 210 and has approximately the same profile. Such overmolding is well known in the plastic molding arts. The overmold 220 is roughly one half an inch thick, although it could vary from as thin as one quarter of an inch to as thick as one inch. The overmold 220 has rounded edges, and the rounded bottom portion 223 of the overmold 220 is curved front to back to conform to the shape of the insert 210 and curved side to side to conform to the shape of the handle 140. This rounding in two directions produces the rounded butt bottom 223. There is also texture molded into the back of the overmold 220. In FIG. 7 the texture is a series of transverse grooves which are designed to minimize potential slippage when the weapon is in use, but it is possible for any type of texture to be incorporated into the overmold 220 including cross hatching or stippling.

The release lever assembly 400 is shown in detail in FIGS. 9, 10, 11 & 12. As seen in the detail view of FIG. 11 and the exploded view of FIG. 12, the release lever assembly 400 is made up of the locking pin 410 with a small hole 412 in the lower portion of the locking pin 410, a release lever 420 that is comprised of two identical and parallel arms 425 that are connected underneath by a lever pad 428. There are two identical and co-axial small roll pin holes 422 in the mid-front portion of the arms 425, and a roll pin 421 that is inserted through the roll pin holes 422 and the pin hole 412 to rotatably hold the locking pin 410 to the release levers 420. Seated below the locking pin 410 is a spring 430, which sits on a spring stop 440 which is attached to the latch guard 148 portion of the enclosed handle 140 by means of an attachment pin 445. There is a receiving hole 149 in the latch guard 148 sized and configured to accommodate the spring stop 440. As seen in the cut away views of FIGS. 9 & 10, the release lever assembly 400 sits in the lever shaft 144 molded into the frame 100. The lever shaft 144 is sized to accommodate the pin 410, spring 430 and beveled spring stop 440. The lever shaft 144 runs from the latch cover 148 to the receiver bore 102 within the body 110, allowing the locking pin 410 to protrude into the receiver bore 102, and when the buffer tube 12 is in place, into one of the buffer tube positioning slots 13 in the bottom of the buffer tube 12 to secure the butt stock 10 into place on the weapon 15.

The spring stop 440 is attached to the latch guard 148 by means of a small pin 445. There is a lever slot 143, which is best seen in the cross section view of FIG. 19, incorporated into the body 110 such that the lever slot provides an opening to a portion of the lever shaft 144. The roll pin 421 which connects the two release levers 420 to the locking pin 410 extend outwardly from the sides of the levers 420, and ride in the lever slot 143. The spring 430 sits in the lever shaft 144 below the locking pin, forcing the locking pin 410 upward. Since the locking pin 410 is attached to the release lever 420, the spring also forces the release lever 420 upward. The release lever 420 sits against the underside 114 of the body 110. Each arm 425 has a lever top 450 consisting of a flat top 451 portion and a drop top 452 portion. In the normal position the spring 430 forces the lever 420 upward, forcing the flat top 451 against the underside 114 to hold the release lever 420 in place.

The user of the weapon can adjust the position of the butt stock 10 on the buffer tube 12 by pulling up on the lever pad 428, which will pull the drop top 452 up against the underside 114 of the butt stock body 110. This will move the release levers 420 down and will pull the locking pin 410 down and out of the positioning slot 13 in the buffer tube 12. The release lever 420 will be held in place as the roll pin 421 rides down in the lever slot 143. This particular configuration allows the user to easily adjust the length of the buffer tube 12 by placing the palm of one hand on the body 110 and pulling up on the release lever 420 by means of the lever pad 428. This allows the user to hold the butt stock 10 with one hand while holding the weapon 15 with the other hand while pulling the locking pin 410 out of the buffer tube 12, and adjusting the position of the butt stock 10. Most buffer tubes 12 have an end guard 14 at the end of the row of positing slots 13 to prevent the butt stock 10 from inadvertently being removed from the weapon 15. In order to fully remove the butt stock 10 from the buffer tube 12, the locking pin 410 must be pulled down even further. This is accomplished by pulling down on the drop top 452. To accomplish this, the user will place the palm of one hand against the latch cover 148 and with the thumb and at least one finger, grasp the release lever 420 on the drop top 452, and pull down. This will force the lever to rotate about the pivot end 423 and force the roll pin 421 to moved down in the lever slot 143, which will draw the locking pin 410 down enough to remove it from the slot 13 in bottom of the buffer tube 12 and enough to allow the end guard 14 to move past the pin 410.

There are two identical storage tubes 113, one on each side of the body 110. The storage tubes 113 are sized to receive batteries or cleaning equipment. As partially seen in the sectional view of FIG. 19, the storage tubes 113 and receiver bore 102 run nearly the entire length of the body 110 from the front 111 to the back 112, but are closed at the end by the extended back plate 120. Each storage tube 113 has an identical cam cap 300 that provides a water tight seal to the opening 115 of the storage tubes 113. The cam cap 300, as seen in FIGS. 13-17, consist of a cap top 320 having a circumference slightly larger than the circumference of the storage tube 113, and an integrated cylindrical plug 310 having a circumference just slightly smaller than the circumference of the storage tube 113. There is at least one circumferential groove 305 around the cylindrical plug 310, and at least one corresponding O-rings 350 sized to sit in the groove 305, and which provide a tight seal within the storage tube 113 when the cam cap 300 is inserted. O-rings are generally made of soft rubber or rubberized plastics and are well known in the relevant arts. There is a tongue 326 extending from one side of the cap top 320, a latch paw 324 extending from the other side, and a cap ridge 321 along the top 320.

Figure 16:
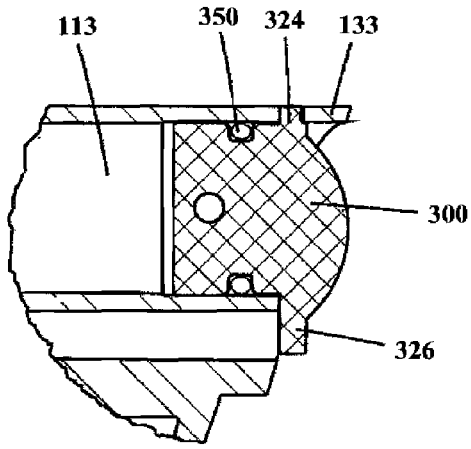
FIG. 16 is a cut away detail showing the cam cap secured in the storage tube.
Figure 15:
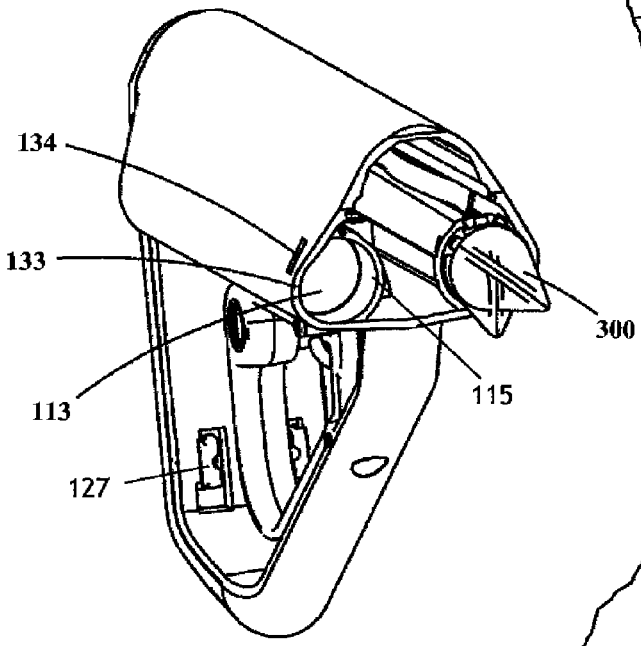
FIG. 15 is a perspective view of the front of the butt stock showing the cam cap plugs.
Figure 17:
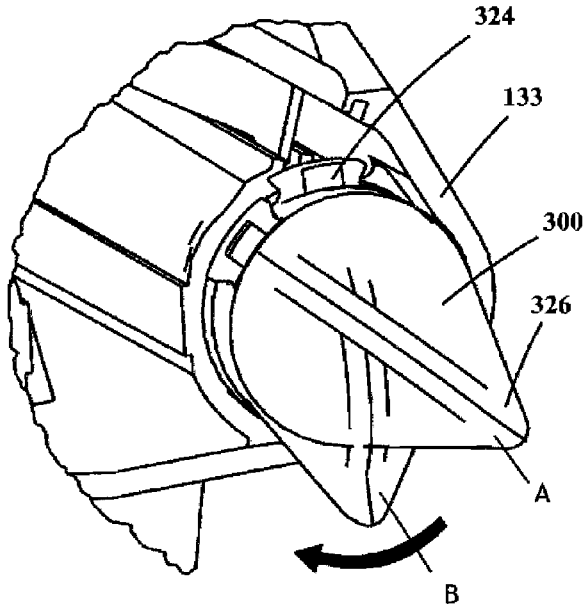
FIG. 17 is a detail of the insertion of the cam cap into the storage tube.
Figure 18:
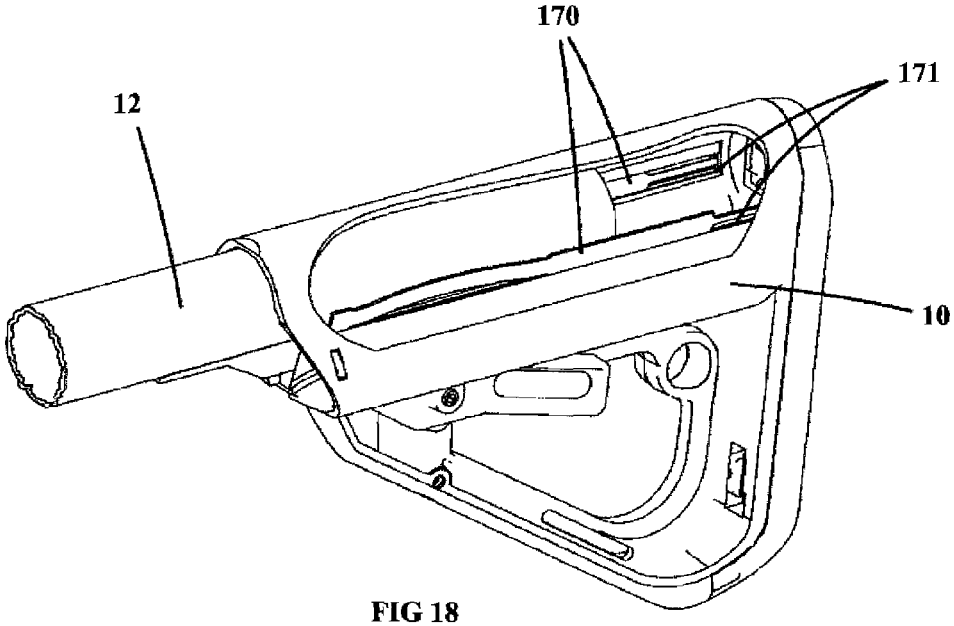
FIG. 18 if a front perspective of the butt stock with a cut away showing the receiver bore and the anti-rattle leaf springs.

As best seen in FIGS. 4 & 5, the front 111 of the butt stock 10 is tapered from the top of the body to the bottom, creating a beveled wall 133 that sits adjacent to the opening 115 of the storage tube 113. There is a latch groove 134 cut into the beveled wall 133 on the side of the front 111 of the butt stock 10, just above the opening 115 of the storage tube 113. The latch groove 134 is sized to accommodate the latch paw 324. When the cam cap 300 is inserted into the storage tube 113 and pushed in as far as possible, the tongue 326 will rest against the beveled wall 133. The user can lock the cam cap 300 into the storage tube 113 by pressing down on the cap top 320 and twisting the cap ridge 321. The cam wall 113 will force the cam cap 300 to twist in only one direction, as seen in FIG. 17. Position A shows the cam cap 300 as inserted into the opening 115, and as it is pressed and inserted the tongue 326 will follow the beveled wall 113 forcing the cam cap 300 into the storage tube 113, as shown as position B. This will allow the cam cap 300 to slide down further into the storage tube 113, and eventually allow the latch paw 324 to fit into the latch groove 134 to lock the cam cap 300 into place. FIG. 16 is a cross section showing the cam cap 300 in place in the storage tube 113. To remove the cam cap 300, the user need only twist the cap ridge 321, and the tongue 326 will follow the beveled wall 133 and draw the cam cap 300 up and out of the storage tube 113 in a cam like motion. This will greatly simplify the removal of the cam cap 300 from the storage tube 113.

Figure 19:
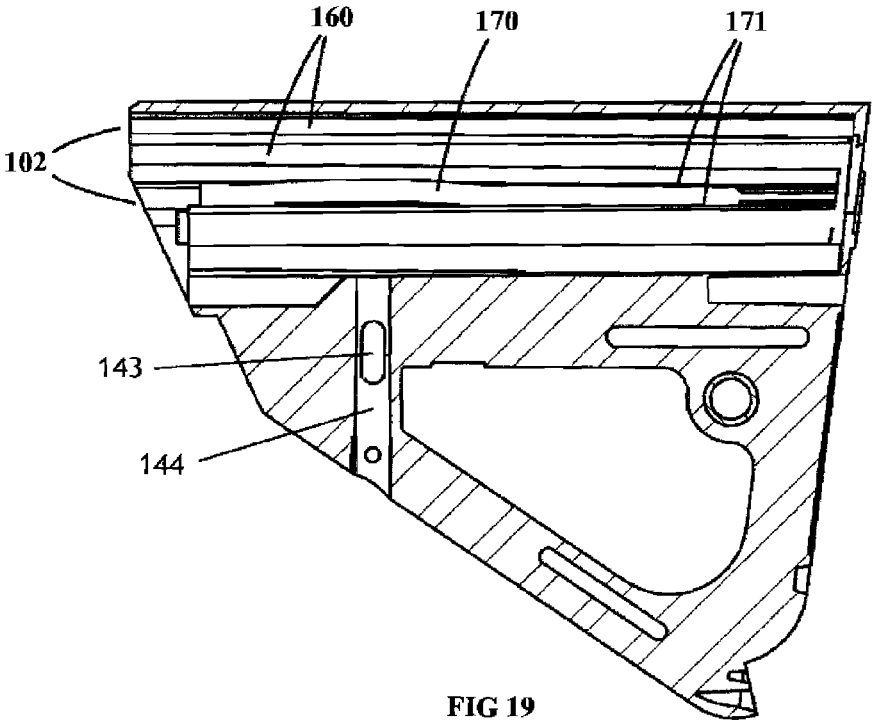
FIG. 19 is a side cross sectional view of the butt stock frame.

There are two anti-rattle springs 170 mounted on the inside walls of the receiver bore 102. FIG. 19 is a cross section which shows the inside of the receiver bore 102, and as can be seen, there is a spring mount groove 171 mounted at the periphery of the receiver bore 102 just above the storage tube 113 and running nearly the length of the receiver bore 102. The anti-rattle spring 170 is an elongated and bent piece of spring steel that runs nearly the length of the receiver bore 102. The springs 170 sit in the grooves 171, and the bent center portion extends just slightly into the receiver bore 102. When the buffer tube 12 is inserted into the receiver bore 102 the springs press against the buffer tube 12, thus providing pressure to secure it into place, and preventing any slippage or movement due to the small discrepancy between the outer diameter of the buffer tube 12 and the inner diameter of the receiver bore 102. The anti-rattle springs 170 have tabbed ends that are sized to securely attach within the mount groove 171.

Figure 20:
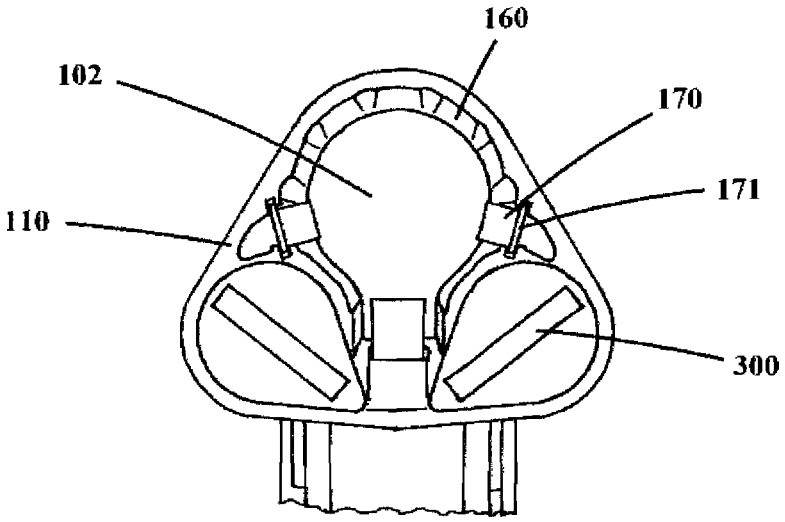
FIG. 20 is a front plan detail showing the receiver bore and the position of the leaf springs and the ribs.
Figure 21:
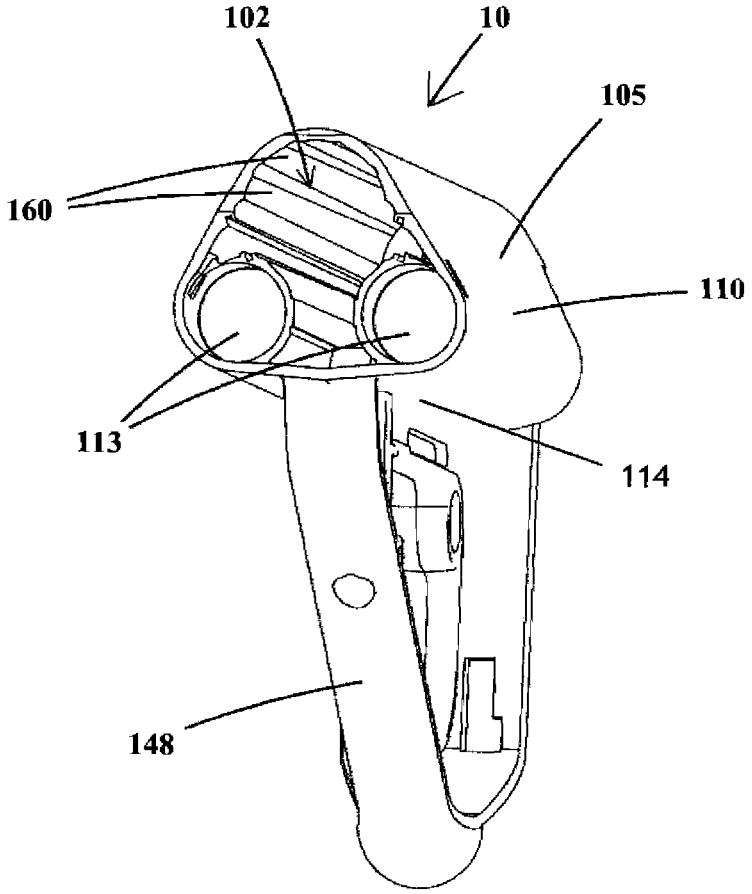
FIG. 21 is a front perspective of the butt stock showing the receiver bore and the ribs.

There are a series of ribs 160 within the receiver bore 102. As seen in FIGS. 20 & 21, the ribs 160 run the length of the receive bore 102. The ribs 160 are created during the same molding or casting process that forms the frame 110 of the butt stock 10. The ribs 160 create a series of channels or grooves 161 therebetween, which reduce drag when the buffer tube 12 is inserted or moved in the receiver bore 102, and the series of ribs 160 and grooves also make it easier to clean the receiver bore 102. As can be appreciated, it is difficult to mold the butt stock 10 to precise dimensions, so there is always the possibility of small discrepancies between two components.

The preferred embodiment of the invention is sized and configured to be attached to the AR15, the civilian version of the military M-16/M-4. It is to be understood that the butt stock could be sized and configured to attach to a variety of other tactical weapons. In the preferred embodiment the circumference of the receiver bore 102 is 1.175 inches to allow attachment to the buffer tube 12 of an AR15. The overall length of the preferred embodiment of the butt stock 10, from the front 111 to the back 112 is 6.90 inches. The overall height of the preferred embodiment of the butt stock 10 is 5.77 inches, from the lowest portion of the rounded ball end 223 to the top of the body 110. The width of the extended back plate 120 of the preferred embodiment of the invention is 1.50 inches. The overall width of the body of the preferred embodiment of the invention is 2.40 inches. The extended back plate 120 of the preferred embodiment of the invention angles in 7 degrees from the vertical. The approximate circumference of the storage tubes 113 of the preferred embodiment of the invention is 0.8 inches. It is to be understood that other embodiments of the invention will have different dimension and will be designed and configured to attach to other weapons.

The present invention is well adapted to carry out the objectives and attain both the ends and the advantages mentioned, as well as other benefits inherent therein. While the present invention has been depicted, described, and is defined by reference to particular embodiments of the invention, such reference does not imply a limitation to the invention, and no such limitation is to be inferred. The depicted and described embodiments of the invention are exemplary only, and are not exhaustive of the scope of the invention. Consequently, the present invention is intended to be limited only be the spirit and scope of the claims, giving full cognizance to equivalents in all respects.

I claim:

1. A removable butt stock for a weapon comprising:

a body having a receiving bore and two storage tubes incorporated therein, said receiving bore configured to attach the butt stock to the weapon;

said body having a back portion having a padded butt plate with a rounded bottom;

said body having a lower portion and an enclosed handle attached thereto;

a two-position release lever mounted within said handle and having a pin that extends through a channel in said body and into said receiver bore;

wherein said weapon has a protruding buffer tube having a bottom and a series of attachment slots along said bottom; and wherein said receiver bore is sized and configured to receive said buffer tube and wherein said pin is configured to insert into one of said attachment slots to secure said butt stock to said weapon.

2. The removable butt stock of claim 1 wherein said storage tubes are configured below said receiving bore thereby creating a triangular cross section shaped body having an angled outer surface to create a cheek weld thereon.

3. The removable butt stock of claim 1 further comprising a series of longitudinal ribs disposed inside said receiver bore to ease the insertion and removal of said buffer tube.

4. The removable butt stock of claim 1 further comprising;

two longitudinal spring retaining grooves incorporated in said receiver bore; and two anti-rattle springs disposed within said retaining grooves;

wherein said anti-rattle springs have a flexed extending portion protruding into said receiver bore, and wherein further said flexed extending portions press against said buffer tube when inserted into said receiver bore to prevent movement during use.

5. The removable butt stock of claim 1 wherein body has a front end and wherein said storage tube has an opening adjacent to said body front; and wherein said butt stock further comprises at least one cam cap sized to securely fit into and close said storage tube opening.

6. The removable butt stock of claim 5 wherein said storage tube opening has a circumference;

said cam cap has a cap top having a circumference larger than the storage tube opening circumference, and a cylindrical plug having a circumference slightly smaller than the storage tube opening circumference, said cylindrical plug having at least one circumferential groove and at least one o-ring disposed in said circumferential groove to provide a snug seal when said cam cap is inserted into said storage tube opening;

said cam cap having a protruding tongue and a latch paw opposite said protruding tongue;

said body front having a beveled wall adjacent said storage tube opening, with a latch slot therein;

wherein when said cylindrical plug of said cam cap is inserted into said storage tube opening said protruding tongue can move along said beveled wall to turn and insert said cam cap into said storage tube opening; and wherein further said latch paw can be engaged in said latch slot to lock said cam cap into place in said storage tube to provide a secure closure to said storage tube.

7. The removable butt stock of claim 1 further comprising;

an extended back plate integral to the back portion of the butt stock body, said extended back plate having a lower portion curved toward said body front;

a padded overmold configured to conform to, and attach to, the extended back plate, said overmold having a bottom portion curved to conform to said back plate lower portion and curved transverse to said back plate lower portion to create a rounded butt bottom;

wherein said rounded butt bottom allows a weapon user to comfortably hold and use said weapon in a tactical fighting position.

8. The removable butt stock of claim 1 wherein said body lower portion further comprises;

a lever shaft disposed in said body lower portion, said lever shaft extending through said lower portion and into said receiver bore;

a roll pin slide slot which is an opening in said lever shaft;

and wherein said two-position release lever further comprises;

two parallel lever arms attached by a lever pad, each of said lever arms having a front pivot point, a flat top portion, a drop top portion and a roll pin hole;

a locking pin attached to said lever arms by means of a roll pin extending through said roll pin holes, said locking pin slidably inserted in said lever shaft such that said roll pin is movably inserted in said roll pin slide slot, and said locking pin extending into said receiver bore;

a spring inserted in said lever shaft below said locking pin, said spring having a spring stop means therebelow;

wherein said locking pin can be moved to a first position by pulling said lever pad towards said body, and wherein said locking pin can be moved to a second position by pulling said drop top portions away from said body;

whereby said butt stock can be adjusted on said buffer tube with the locking pin in the first position and said butt stock can be removed from said buffer tube with the locking pin in the second position.

9. The removable butt stock of claim 7 further comprising;

a body front portion at the front of said body;

a latch guard attached to said extended back plate lower portion and to said body front portion to create an open handle and a guard for the release lever.

10. A tactical weapon butt stock comprising:

means for attaching, securing and adjusting the butt stock to a protruding buffer tube of the weapon;

means for preventing rattle movement of the butt stock when attached to the protruding buffer tube of the weapon, said means for preventing rattle movement of the butt stock when attached to the weapon comprising;

a receiver bore disposed within said butt stock;

at least two longitudinal mounting grooves incorporated within said receiver bore;

at least two elongated springs disposed within said mounting grooves; wherein said elongated springs have a curved protrusion that engages and imparts pressure on said protruding buffer tube to prevent movement of said butter tube when secured within said receiver bore;

rounded butt stock means for improving the comfort of the butt stock when held against the upper chest in a tactical fighting position;

angled cheek rest means for improving the comfort of the weapon when held against the face for firing;

storage tube means for storing and securing supplies within said butt stock; and means for preventing components of the butt stock such as a release lever, a trigger and a multiplicity of clips from becoming a catching hazard.

11. The tactical weapon butt stock of claim 10 wherein said means for attaching, securing and adjusting said butt stock to said weapon comprises:

said butt stock having a hollow body with an integrated receiver bore disposed from a front of said body to a back of said body, and sized and configured to engage a protruding buffer tube portion of the weapon, said protruding buffer tube having a series of longitudinal attachment slots;

a release lever having a locking pin, said release lever moveably attached to said butt stock body, and said locking pin slidably inserted in said body, extending into said receiver bore, and configured to engage one of said attachment slots to secure said butt stock to said weapon.

12. The tactical weapon butt stock of claim 10 wherein said rounded butt stock means for improving the comfort of the butt stock when held against the upper chest in a tactical fighting position comprises:

an extended back plate attached to the butt stock, said extended back plate having a curved lower portion; and a padded butt plate attached to said extended back plate, said padded butt plate having a rounded bottom portion; wherein said rounded bottom portion allows a user of the weapon to comfortably hold the weapon in the tactical fighting position against the upper chest.

13. The tactical weapon butt stock of claim 10 wherein said angled cheek rest means for improving the comfort of the weapon when held against the face for firing comprises:

an angled exterior side portion of said butt stock, said angled side portion formed by the position of the storage tube means adjacent and below said receiver bore to create a triangular cross section to provide an angled cheek rest for a user of the weapon when holding the weapon against the face and aligning the weapon for firing.

14. The tactical weapon butt stock of claim 11 wherein said storage tube means for storing and securing supplies within said butt stock comprises;

at least two longitudinal storage tubes running from the front to the rear of the butt stock and disposed within the hollow body, said storage tubes having an opening adjacent the front of the butt stock; and at least two cam caps sized and configured to close said storage tube openings.

15. The tactical weapon butt stock of claim 14 wherein said means for storing and securing supplies within said butt stock further comprises;

a front portion of said butt stock, said front portion having a beveled wall;

a slot hole cut in said beveled wall adjacent to said storage tube opening;

wherein said cam caps have a protruding tongue and a paw, said paw sized to engage said slot hole; and wherein said tongue guides said cam cap into said opening by sliding against said beveled wall and turning said cam cap to engage said paw into said slot hole.

16. The tactical weapon butt stock of claim 10 wherein means for preventing components of butt stock from becoming a catching hazard comprises:

a guard rail disposed between said front of said butt stock and lower portion of said extended back plate creating an opening therebetween; wherein said release lever and a multiplicity of attachment clips and slots are mounted on said butt stock within said opening; and wherein further said guard rail prevents external objects from catching on said release lever or said multiplicity of clips and slots.

17. A butt stock for a tactical weapon comprising:

a hollow body having an outside, a front, a back and an underside and containing a receiver bore and two storage tubes therein, said storage tubes having openings at the front of said body, and said receiver bore having an opening at the front of the body and sized to accommodate a buffer tube of a weapon;

said receiver bore having internal ribs to allow smooth insertion of the buffer tube therein;

at least two anti-rattle springs mounted in said receiver bore to prevent movement of the buffer tube when attached within said receiver bore;

an extended back plate attached to the back of said butt stock body and providing a back closure to said receiver bore and said storage tubes, said extended back plate having a back plate bottom with an inwardly curved surface;

said storage tubes sitting side by side and below said receiver bore to give said outside of said body a triangular shape which creates an angled cheek weld;

a padded butt plate attached to said extended back and having curved sides and a rounded ball bottom;

a two-position release lever attached to the underside of the body and having an integrated locking pin that extends into said receiver bore; wherein said buffer tube has a bottom with a series of adjustment slots positioned thereon, and wherein said locking pin engages one of said series of adjustment slots to position said buffer tube and secure said butt stock to said weapon, said release lever having a first position to move said locking pin to allow adjustment of the position of said buffer tube, and a second position to move said locking pin to allow insertion or removal of said buffer tube from said receiver bore;

an enclosed handle consisting of a latch guard running from said back plate bottom to the underside front of said body; wherein said enclosed handle has an opening therein with said release lever positioned within said opening, and wherein said enclosed handle protects said release lever from becoming a snag hazard;

two cam caps sized to insert and close the openings of said storage tubes, wherein said front of said body has an angled wall adjacent to said storage tube openings and wherein said cam caps have a protruding tongue that slides up and down said angled wall, and wherein said angled wall has a latch slot and said cam caps have a latch paw opposite said protruding tongue wherein said latch paw engages said latch slot to lock said cam cap into said storage tube opening, and wherein said protruding tongue slides up said angled wall to ease removal of said cam cap from said storage tube opening.

* * * * *